United States Patent [19]

Chumanov et al.

[11] 4,201,075

[45] May 6, 1980

[54] METHOD OF ROLLING SECTION BILLETS

[76] Inventors: Julian M. Chumanov, ulitsa Rozy Ljuxemburg, 65, kv.33; Valentin M. Klimenko, bulvar Pushkina, 29, kv. 34; Grigory M. Shulgin, ulitsa Izjumovskaya, 5, kv. 232; Vyacheslav F. Gubaidulin, ulitsa Schorsa, 23, kv. 16, all of Donetsk; Vladimir P. Timofeev, ulitsa Kievskaya,12, kv. 63, Dnepropetrovsk; Vladimir P. Slednev, ulitsa Artema, 147 V, kv. 35, Donetsk; Stanislav N. Ignatiev, ulitsa Saratovskaya, 24, Donetsk; Pavel A. Levichev, ulitsa Orbity, 131, Donetsk; Jury P. Lyashenko, ulitsa Universitetskaya, 58, kv. 53, Donetsk, all of U.S.S.R.

[21] Appl. No.: 875,414

[22] Filed: Feb. 6, 1978

[51] Int. Cl.[2] ..... B21B 1/00

[52] U.S. Cl. ..... 72/204; 72/221; 72/234; 72/366

[58] Field of Search ..... 72/203, 204, 222, 221, 72/234, 5, 366; 29/526.2–526.4, 412; 164/76

[56] References Cited

U.S. PATENT DOCUMENTS

| | | | |
|---|---|---|---|
| 885,508 | 4/1908 | McKee | 72/324 |
| 1,977,285 | 10/1934 | McCleery | 72/235 X |

*Primary Examiner*—Milton S. Mehr

*Attorney, Agent, or Firm*—Lackenbach, Lilling & Siegel

[57] ABSTRACT

A method of rolling section billets wherein a plurality of billets transversely interconnected by bridges are successively simultaneously formed from a slab in a number of grooves defined by a plurality of transversely juxtaposed grooves. The forming is effected in two stages by reducing the value of longitudinal tensile stresses in central portions of the billets at one stage by changing the position of zones of prevailing reduction transversely of the billets, with the subsequent separation of billets from one another.

16 Claims, 8 Drawing Figures

METHOD OF ROLLING SECTION BILLETS

BACKGROUND OF THE INVENTION

The invention relates to metal forming, and more particularly to a method of rolling section billets.

The invention may be used in both existing and new reversible and continuous billet rolling mills and also in the construction of combined plants including a continuous metal casting machine and a rolling mill, as well as in the manufacture of section rolled products for multistrand rolling, e.g. in a roughing group of wire mills.

The invention enables an improvement of output of existing rolling mills and construction of new highly efficient combined plants including a continuous metal casting machine and a rolling mill.

In many industrially developed countries, the demand for various section rolled products which are manufactured from section billets has been increasing due to the enormous growth of metal consuming industries.

The need to improve the output of reducing and billet rolling mills has brought about new methods for the manufacture of billets.

Nowadays, the method of rolling section billets is in accordance with a single ingot-blooming-continuous billet rolling mill which is generally the one most widely used. Substantially all known methods of improving the output of such devices have reached their limit.

At present, the manufacture of section billets in continuous metal casting machines is rapidly developing.

The manufacture of billets directly by continuous casting method is only possible using continuous metal casting machines having a large number of strands, which requires large capital investments.

More efficient is a method of continuous casting of large-section billets with subsequent rolling thereof in continuous billet rolling mills. This method, however, also requires large investments.

The use of a less known method of producing section billets by reducing continuously cast slabs in reducing plants is also limited due to a number of important disadvantages.

Most promising and highly efficient method of the manufacture of section billets consists in rolling and splitting a rolled or continuously cast wide billet in multipass grooves defined by a plurality of transversely juxtaposed grooves.

Known in the art is a method of making twin billets, in which a continuously cast rectangular-section slab is rolled between a number of twin grooves arranged in series, the cross-sectional shape of the groove gradually approximating a square of rhombus. The resultant billets are then cut apart by means of gas cutters.

While having the advantages of twin rolling of billets, this method is deficient in prevailing reduction of billets in the bridge zone. Longitudinal stresses appearing in less reduced central portions of the billets result in surface flows and internal flaws.

Also known in the art is a method for improving quality of rolled products in which an ingot of square or almost square section is cast and then rolled into a plurality of billets transversely interconnected by bridges in such a manner that phase separation zone remains limited to the middle portion or middle portions of the cross-section, and then the section product is separated at the bridges into individual products free of phase separation zones and containing phase separation zones.

It should be noted that this method is deficient in that the quality of metal is impaired during rolling due to considerable tensile stresses in the central portions of the billets in all passes, which results in the uncovering of surface flaws.

Another prior art method of continuously making section billets comprises the step of subjecting a continuous slab leaving a mould to a successive reduction between a series of calibrated rolls until complete solidification. As a result of deformation of wider sides, the slab takes a shape of a plurality of interconnected square billets. After secondary cooling with sprayed water, the billets are cut lengthwise and transversely to obtain measured lengths.

The disadvantage of this method resides in a trend to the formation of surface flaws, which is more pronounced due to the presence of a liquid core.

A further prior art method of multistrand rolling of metal section products comprises a multistrand rolling of two or more section products, with subsequent splicing by cutting-off a thin metal bridge in either the hot or, preferably, cold state.

This highly efficient method of multistrand rolling is, however, deficient in prevailing reduction of billets in the bridge zone in all grooves, e.g. in rolling square billets. This results in the appearance of considerable longitudinal tensile stresses in the less reduced central portions of the billets and in surface flaws in these portions. This trend is most pronounced in rolling borely deformable grades of steel by the multistrand method.

It is an object of the invention to eliminate the above-mentioned disadvantages.

Another object of the invention is to provide a method of multistrand rolling of section billets with guaranteed quality of metal continuity, which depends on the quality of the starting billet, due to a reduction of longitudinal tensile stresses.

The invention consists in the provision of a method of multistrand rolling of section billets with guaranteed quality of metal continuity which depends on the quality of the starting billet, due to a reduction of longitudinal tensile stresses.

SUMMARY OF THE INVENTION

The above objects are accomplished by a method of rolling section billets comprising successively simultaneously forming a plurality of billets transversely interconnected by bridges from a slab in a number of grooves defined by a plurality of transversely juxtaposed grooves, with subsequent separation of billets from one another. The billets are formed in at least two stages, by reducing the value of longitudinal tensile stresses in the central portions of the billets at one stage and changing the position of zones of prevailing reduction transversely of the billets.

By this method, the trend to and the formation of surface flaws in the central portions of the billets being rolled is reduced.

Longitudinal tensile stresses in the central portion of the billets are preferably reduced with their transition into longitudinal compressive stresses.

This facility guarantees the absence of surface flaws in the central portion of the billets being rolled.

In accordance with one embodiment of the invention, the change in the position of zones of prevailing reduction transversely of the billets is effected by forming billets in grooves of different shape, e.g. in a groove with hexagonal shapes at the first stage and in a groove with rectangular or square shapes at the second stage.

Successive rolling of billets in grooves of such shape permit the position of zones of prevailing reduction of billets to be transferred at one stage from the bridge zones into the zones of the central portions of the billets.

In another embodiment of the invention, the billets are formed in grooves having rhombic shapes with a different angle of inclination of the groove walls at each stage.

This facility permits the position of zones of prevailing reduction to be transferred from the bridge zones into the zones of the central portions of the billets.

A further embodiment of the invention permits the position of zones of prevailing reduction to be changed transversely of the billets by forming the billets in grooves having adjacent passes of different shape.

Successive rolling of billets in grooves of such shape permits the position of zones of prevailing reduction to be transferred from the bridge zones into the zones of the central portions of the billets.

The same result may be obtained by forming billets in a single groove having adjacent grooves of different shape by displacing the billets interconnected by bridges at least one stage axially along the rolls by the amount of the width of at least one pass.

BRIEF DESCRIPTION OF THE DRAWINGS

The invention will now be described with reference to specific embodiments thereof illustrated in the accompanying drawings, in which.

BRIEF DESCRIPTION OF THE PREFERRED EMBODIMENT

Specific embodiments of the method of rolling section billets according to the invention will be described in detail.

Where multistrand rolling of billets is effected on a reversible mill of the blooming type, the billet is preferably formed at several stages alternately in two adjacent grooves with different shapes thereof.

Figure 1:
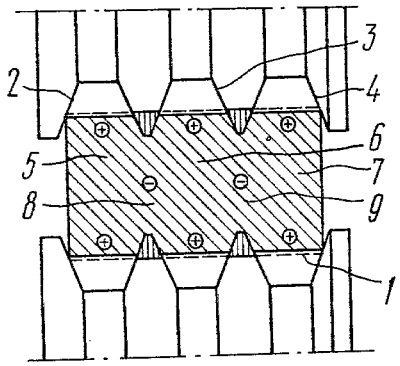
FIG. 1 diagrammatically shows rolling in a first stage of a starting billet in a triple groove having hexagonal shapes.

A starting billet (slab ) 1 (FIG. 1) is rolled at the first stage in a triple groove having hexagonal shapes 2, 3 and 4.

A multiple billet formed in this groove consists of billets 5, 6 and 7 interconnected by bridges 8 and 9. Any non-uniform deformation transversely of the starting billet resulting from local reduction thereof in the zone of the bridges 8 and 9 contributes to the appearance of zones of longitudinal tensile (+) and compressive (+) stresses in the cross-section of the multiple billet.

The less reduced or non-reduced zones of the billets deter the stretching of the greater or more reduced zones thereby contributing to the appearance of longitudinal compressive stresses in the more reduced zones. On the contrary, such more reduced zones contribute to a greater or more intense stretching of the less reduced or non-reduced zones thereby favoring the appearance of longitudinal tensile stresses in the less reduced zones.

Longitudinal compressive stresses (−) appear in the zone of the bridges 8 and 9, and longitudinal tensile stresses (+) appear in the central non-reduced portions of the billets 5, 6 and 7. Tensile stresses (+) contribute to the appearance of surface flaws, formation of internal voids and cracks.

Figure 2:
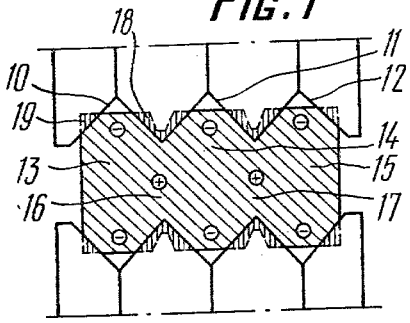
FIG. 2 diagrammatically shows rolling in a second stage of an intermediate multiple billet in a triple groove having diagonal square shapes.

The resultant multiple billet is rolled at the second stage in a triple groove having rectangular shapes 10, 11 and 12 (FIG. 2) to form a multiple billet consisting of billets 13, 14 and 15 interconnected by bridges 16 and 17. Zones 18 and 19 of prevailing reduction of billets are displaced from the zone of the bridges 16, 17 and the lateral sides of the lateral billets 13, 15 towards the central portions of the billets 13, 14, 15. This contributes to the reduction of longitudinal tensile stresses (+) in the central portions of the billets 13, 14, 15 or to the appearance of longitudinal compressive stresses (−) and tensile stresses (+) in the zone of the bridges 16, 17.

Figure 3:
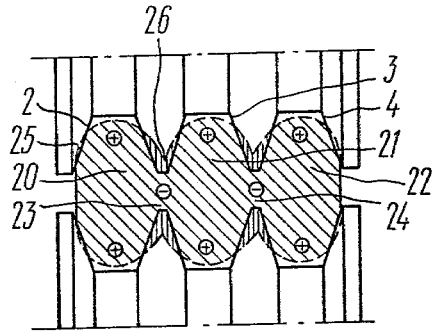
FIG. 3 diagrammatically shows rolling in a third stage of an intermediate multiple billet in a triple groove having hexagonal shapes.

At the third stage, the multiple billet is again rolled in a triple groove having hexagonal shapes 2, 3 and 4 (FIG. 3) to form billets 20, 21, and 22 interconnected by bridges 23 and 24. The zones 25 and 26 of prevailing reduction are located close to the bridges 23 and 24. This results in the appearance of longitudinal compressive stresses (−) in the zone of the bridges 23 and 24 and longitudinal tensile stresses (+) in the central portions of the bridges 20, 21 and 22.

Figure 4:
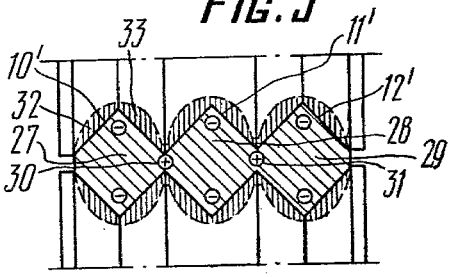
FIG. 4 diagrammatically shows rolling in a fourth stage of an intermediate multiple billet in a triple groove having diagonal square shapes.

At the fourth stage, the multiple billet is rolled in a triple groove having square shapes 10', 11' and 12' (FIG. 4) to form billets 27, 28 and 29 interconnected by bridges 30 and 31. In this case, zones 32, and 33 of prevailing reduction are located closer to the central portions of the billets 27, 28, 29. This contributes to the appearance of longitudinal tensile stresses (+) in the zones of the bridges 30 and 31 and longitudinal compressive stresses in the central zones of the billets.

Further, the multiple billet is split into individual billets by any appropriate known method, such as by using an oxygen-gas cutter.

A change in position or alternation of the less or non-reduced and reduced zones of the billets contributes to the reduction of longitudinal tensile stresses in the less reduced (non-reduced) zones or to the alternation or rearrangement of zones of longitudinal tensile and compressive stresses. This facility reduces the trend to or eliminates the formation of surface flaws and internal flaws, such as voids and cracks in central portions of the billets.

In rolling billets by a known multistrand method on a reversible mill of the blooming type, tensile stresses at all stages of the billet formation are concentrated in the central portions. This results in surface flaws and internal flaws in these parts of the billets (especially in rolling low-ductility steel grades).

Where billets are rolled by the multistrand method on a continuous rolling mill or a mill with tandem stands, the billets are preferably formed in grooves having rhombic shapes with a different angle of inclination of the groove wall at each stage.

Figure 5:
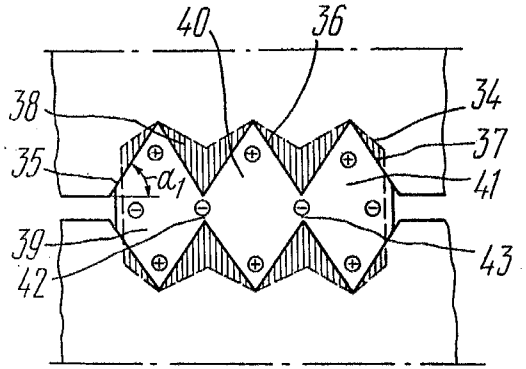
FIG. 5 diagrammatically shows rolling of an intermediate multiple billet in a triple groove having rhombic shapes.

An intermediate multiple billet 34 (FIG. 5) is rolled in a triple groove having rhombic shapes 35, 36 and 37 with angle of inclination of groove walls $\alpha_1$. Zones 38 of prevailing reduction of the billets 39, 40 and 41 are located in the zone of bridges 42 and 43. Longitudinal tensile stresses (+) appear in the central portions of the billets 39, 40, 41, and compressive stresses (−) appear in the zone of the bridges 42 and 43.

Figure 6:
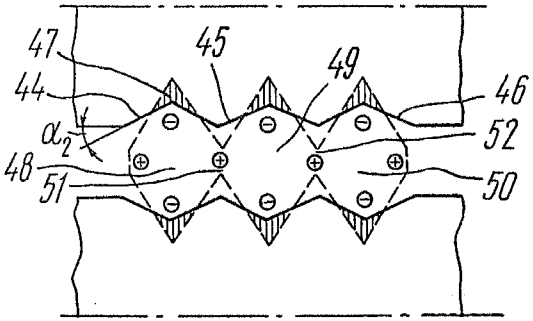
FIG. 6 diagrammatically shows rolling in a next stage of an intermediate multiple billet in a triple groove having rhombic shapes.

At the next stage, the multiple billet is rolled in a triple groove having rhombic shapes 44, 45 and 46 (FIG. 6) with a smaller angle of the inclination of groove walls $\alpha_2$. Zones 47 of prevailing reduction of the billets 48, 49 and 50 are displaced towards the central portions of the billets. This contributes to the appearance of longitudinal tensile stresses (+) in the zone of bridges 51 and 52 and longitudinal compressive stresses (−) in the central portions of the billets 48, 49, 50. During subsequent rolling of the multiple billet, alternation of zones of prevailing reduction is similarly effected by forming billets in grooves having rhombic shapes with different angles of inclination of the walls.

This facility permits the zones of longitudinal tensile and compressive stresses to be alternated in the cross-section of the multiple billet and hampers the appearance of flaws in the central portions of the billets.

In multistrand rolling of billets by known methods, a starting billet is successively rolled in a number of multiple grooves having rhombic shapes with increasing angle of inclination of groove sides. In such case, in all passes, zones of prevailing reduction of billets are located in the zone of bridges. Unidirectional non-uniformity of deformation of this type results in the appearance of longitudinal tensile stresses in central portions of the billet at all stages of rolling and contributes to the formation of surface flaws and internal flaws in these portions.

In case of multistrand rolling of billets in two reversible tandem stands, favorable change in the position of zones of prevailing reduction is preferably made in multiple grooves having adjacent grooves of different shape.

The same result is achieved in rolling a multiple billet in a single multiple groove (to economize the roll barrel in a single-stand reversible rolling mill) having adjacent grooves of different shape by displacing the multiple billet at regular intervals axially along the rolls by the amount of the width of one groove.

Figure 7:
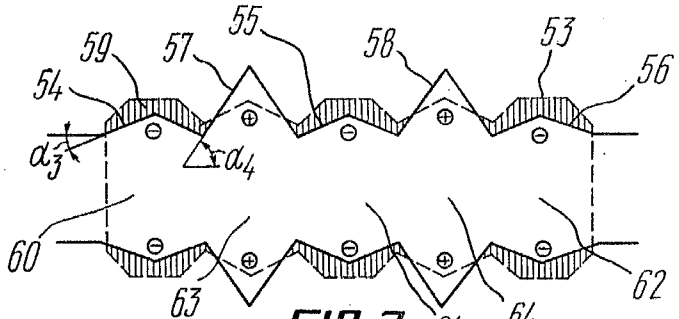
FIG. 7 diagrammatically shows rolling of an intermediate multiple billet in a quintuple groove having adjacent grooves of different shape.
Figure 8:
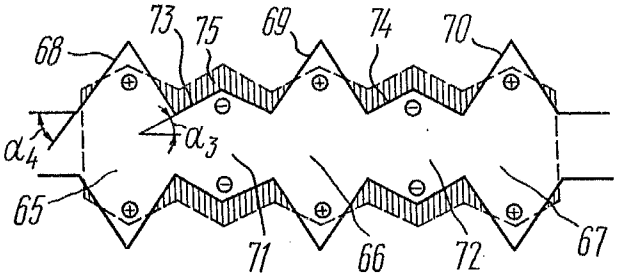
FIG. 8 diagrammatically shows rolling in a next stage of an intermediate multiple billet in a quintuple groove having adjacent grooves of different shape.

An intermediate multiple billet 53 (FIG. 7) formed in a preceding groove is rolled in a quintuple groove. The pass has adjacent grooves of different shape: obtuse rhombic grooves 54, 55, 56 with an angle of inclination of the groove walls $\alpha_3$ and acute rhombic grooves 57, 58 with an angle of inclination $\alpha_4$ (FIG. 8).

In this case, zones 59 of prevailing reduction are concentrated at billets 60, 61 and 62 (FIG. 7) which are formed in the obtuse rhombic grooves. Longitudinal compressive stresses (−) develop in these billets. In billets 63, 64 which are formed in the acute rhombic grooves, longitudinal tensile stresses (+) develop.

In the next pass, the multiple billet is rolled in such a manner that billets 65, 66 and 67 (FIG. 8) with an obtuse angle at the vertex are formed in the acute rhombic grooves 68, 69, 70.

Billets 71 and 72, which have been rolled in acute rhombic grooves, are formed in obtuse rhombic grooves 73, 74.

Zones 75 of prevailing reduction are concentrated transversely of the billets 71 and 72, which contributes to the appearance therein of longitudinal compressive stresses (−). Longitudinal tensile stresses appear in the billets 65, 66, 67. Alternation of the kind of longitudinal stresses in the cross-section of the billets prevents the formation of flaws.

While the invention has been described, disclosed, illustrated and shown in terms of an embodiment or modification which it has assumed in practice, the scope of the invention should not be deemed to be limited by the precise embodiment or modification herein described, disclosed, illustrated or shown, such other embodiments or modifications as may be suggested to those having the benefit of the teachings herein being intended to be reserved especially as they fall within the scope and breadth of the claims here appended.

We claim:

1. A method of rolling section billets in at least two stages comprising the steps of rolling a slab successively so as to form a plurality of juxtaposed billets including outer billets, all having central portions and lateral side portions interconnected by bridge zones, using a series of passes formed of opposing rolls having a gap therebetween and a plurality of transversely aligned grooves by reducing the value of longitudinal tensile stresses in the central portions of said billets at at least one of said stages by changing the position of zones of prevailing reduction transversely of said billets so that said zones are displaced from the zone of said bridges and the lateral sides of the outer billets towards the central portions of said billets, and separating said billets from one another after said billets have been finally shaped; whereby surface flaws and internal flaws in said central portions of said billets are minimized by the reduction of said longitudinal tensile stresses in said portions or zones of said billets.

2. A method of rolling section billets according to claim 1, wherein said longitudinal tensile stresses are reduced until they are transformed into longitudinal compressive stresses as a result of changing the location of the prevailing reduction zones over the width of said billets by transferring the location of said zones from the area of said bridges and the lateral sides of the outer billets to the central portion of said billets.

3. A method of rolling section billets, according to claim 2, wherein the position of said zones of prevailing reduction is changed transversely of said billets by forming said billets in two types of grooves of different shape.

4. A method of rolling section billets according to claim 3, wherein said billets are formed at the first stage in a groove having hexagonal shapes and at the second stage, in a groove having rectangular shapes.

5. A method of rolling section billets according to claim 3, wherein said billets are formed at the first stage in a groove having hexagonal passes and at the second stage, in a groove having square passes.

6. A method of rolling section billets according to claim 3, wherein said billets are formed in a groove having rhombic shapes with different angles of inclination of the groove walls at each stage.

7. A method of rolling section billets according to claim 3, wherein said billets are formed at each stage in grooves having adjacent grooves of different shape.

8. A method of rolling section billets according to claim 7, wherein each of the stages are effected in a single multiple groove pass having adjacent grooves of different shape by displacing said billets interconnected by bridges axially along the rolls by at least the width of one of said grooves.

9. A method of rolling section billets according to claim 1, wherein the position of said zones of prevailing reduction is changed transversely of said billets by forming said billets in two types of grooves of different shape.

10. A method of rolling section billets according to claim 9, wherein said billets are formed at the first stage in a groove having hexagonal shapes and at the second stage, in a groove having rectangular shapes.

11. A method of rolling section billets according to claim 9, wherein said billets are formed at the first stage in a groove having hexagonal shapes and at the second stage, in a groove having square shapes.

12. A method of rolling section billets according to claim 9, wherein said billets are formed in grooves having rhombic shapes with different angles of inclination of groove walls at each stage.

13. A method of rolling section billets according to claim 12 or 6, wherein the angle of inclination of said second stage is smaller than that of said first stage.

14. A method of rolling section billets according to claim 9, wherein said billets are formed at each stage in grooves having adjacent grooves of different shape.

15. A method of rolling section billets according to claim 14, wherein each of the stages of the formation of said billets are effected in a single multiple groove pass having adjacent grooves of different shape by displacing said billets interconnected by bridges axially along the rolls by at least the width of one of said grooves.

16. A method of rolling section billets according to claim 9, including repeating the rolling steps prior to separating said billets.

* * * * *